US010964292B2

(12) United States Patent
Kim

(10) Patent No.: US 10,964,292 B2
(45) Date of Patent: Mar. 30, 2021

(54) SYSTEM WITH DISPLAY APPARATUSES AND METHOD OF CONTROLLING THE SAME

(71) Applicant: SAMSUNG ELECTRONICS CO., LTD., Suwon-si (KR)

(72) Inventor: Kwangmin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/656,146

(22) Filed: Oct. 17, 2019

(65) Prior Publication Data

US 2020/0126514 A1 Apr. 23, 2020

(30) Foreign Application Priority Data

Oct. 18, 2018 (KR) ..... 10-2018-0124141

(51) Int. Cl.
*G09G 5/14* (2006.01)

(52) U.S. Cl.
CPC ..... *G09G 5/14* (2013.01); *G09G 2300/026* (2013.01); *G09G 2310/08* (2013.01); *G09G 2320/0247* (2013.01); *G09G 2370/10* (2013.01)

(58) Field of Classification Search
CPC ..... G09G 5/12; G09G 5/14; G09G 5/006; G09G 2300/026
See application file for complete search history.

(56) References Cited

U.S. PATENT DOCUMENTS

2005/0018089 A1 1/2005 Chun
2013/0181884 A1* 7/2013 Perkins ..... G06F 3/1423 345/1.3
2013/0195119 A1* 8/2013 Huang ..... H04L 65/608 370/468
2017/0069289 A1 3/2017 Oh
(Continued)

FOREIGN PATENT DOCUMENTS

KR 101548351 B1 8/2015
KR 10-2016-0079365 A 7/2016
(Continued)

OTHER PUBLICATIONS

International Search Report and Written Opinion (PCT/ISA/210 & 237) dated Feb. 19, 2020 issued by the International Searching Authority in counterpart International Application No. PCT/KR2019/013482.

*Primary Examiner* — Kevin M Nguyen
(74) *Attorney, Agent, or Firm* — Sughrue Mion, PLLC

(57) ABSTRACT

A display system, a display apparatus, and a method of operating the same are provided. The display system includes: a plurality of display apparatuses connected in series to each other, each display apparatus including: a display, a signal inputter/outputter configured to receive an image signal as a data packet from a preceding display apparatus, and transmit the image signal to a next display apparatus, and a processor configured to: process, for display on the display, an image based on the received image signal, and based on an abnormality in the image displayed on the display, control the signal inputter/outputter to transmit, to the preceding display apparatus, a request for a corrected image signal, of which a signal characteristic in the received image signal is modified.

18 Claims, 10 Drawing Sheets

(56) References Cited

U.S. PATENT DOCUMENTS

| | | | | |
|---|---|---|---|---|
| 2017/0139664 | A1 | 5/2017 | Park | |
| 2018/0165051 | A1 | 6/2018 | Kim et al. | |
| 2019/0005917 | A1* | 1/2019 | Urata | G09G 5/12 |

FOREIGN PATENT DOCUMENTS

| | | | |
|---|---|---|---|
| KR | 1020170028165 | A | 3/2017 |
| KR | 1020170055636 | A | 5/2017 |

* cited by examiner

FIG. 8

800

| THE NUMBER OF TIMES LINK TRAINING IS FAILED | VOD (μA) | PRE (dB) |
|---|---|---|
| 0 (Default) | 100 | 0 |
| 1 | 120 | 0 |
| 2 | 130 | 0 |
| 3 | 140 | 3.5 |
| 4 | 150 | 3.5 |
| 5 | 160 | 3.5 |
| 6 | 170 | 3.5 |
| 7 | 180 | 6 |
| 8 | 190 | 6 |
| 9 | 200 | 6 |
| 10 | 240 | 6 |
| GREATER THAN 11 | ERROR MESSAGE | |

FIG. 9

900

| THE NUMBER OF TIMES FLICKERING OCCURS | VOD (μA) | PRE (dB) |
|---|---|---|
| 0 (Default) | 100 | 0 |
| 1 | 120 | 0 |
| 2~5 | 160 | 0 |
| 6~10 | 160 | 3.5 |
| 11~15 | 180 | 3.5 |
| 16~20 | 200 | 3.5 |
| 21~25 | 200 | 6 |
| 26~30 | 240 | 6 |
| GREATER THAN 30 | ERROR MESSAGE | |

SYSTEM WITH DISPLAY APPARATUSES AND METHOD OF CONTROLLING THE SAME

CROSS-REFERENCE TO RELATED APPLICATION(S)

This application is based on and claims priority under 35 U.S.C. § 119 to Korean Patent Application No. 10-2018-0124141, filed on Oct. 18, 2018, in the Korean Intellectual Property Office, the disclosure of which is incorporated by reference herein in its entirety.

BACKGROUND

1. Field

The disclosure relates to a system including a plurality of display apparatuses connected to each other and together display an image based on an image signal received from an image source, and a method of controlling the same, and more particularly to a system including a plurality of display apparatuses, which has a structure for coping with an error in receiving an image signal to normally display an image in each display apparatus, and a method of controlling the same.

2. Description of Related Art

To compute and process predetermined information in accordance with certain processes, an electronic apparatus generally includes a central processing unit (CPU), a chipset, a memory, and the like electronic components for the computation. Such an electronic apparatus may be variously classified in accordance with what information will be processed and what it is used for. For example, the electronic apparatus is classified into an information processing apparatus such as a personal computer (PC), a server or the like for processing general information; an image processing apparatus for processing image data; an audio apparatus for audio processing; home appliances for miscellaneous household chores; etc. The image processing apparatus may be realized by a display apparatus that displays processed image data as an image on its own display panel. As an example of realizing the image processing apparatus by a single display apparatus, there are a TV, a monitor, a portable multimedia player, a tablet computer, a mobile phone, etc. As an example of actualizing the image processing apparatus by a plurality of display apparatuses, there is a video wall. The video wall refers to a system that forms a large screen by a plurality of display apparatuses arranged in a matrix form.

There are many methods of transmitting an image signal from an image source to each display apparatus. Among these methods is a loop-out method. The loop-out method refers to a kind of serial-connection method based on cable connection between the apparatuses, in which an image signal output from the image source is input to the first display apparatus, the image signal is branched from the first display apparatus, and the image signal branched from the first display apparatus is input to the display apparatus. Such an input/output pattern is applied to all the display apparatuses within the system.

In the system using the loop-out method, there may be many reasons that an image is abnormally displayed in a certain display apparatus even though normal connection is made in a preceding display apparatus. For example, the preceding display apparatus may receive a clean image signal in the loop-out system. However, more noise is accumulated in the image signal toward the back of the loop-out system, and such accumulated noise and other various reasons may cause an image to not be displayed, to not be displayed properly, or to flicker. Of course, a user may check the display apparatus and take a proper measure to solve the problem. However, it is inconvenient for a user to directly take such a measure, and it may also be difficult for a user to determine the cause of the problem.

Accordingly, user convenience and device functioning would improve if the display apparatus can automatically identify a problem and take a proper measure when an image is abnormally displayed on the corresponding display apparatus connected by the loop-out method.

SUMMARY

Provided are a system including a plurality of display apparatuses connected to each other to display an image based on an image signal received from an image source and diagnose and resolve an error in the received image signal, and a method of controlling the same.

Additional aspects will be set forth in part in the description which follows and, in part, will be apparent from the description, or may be learned by practice of the presented embodiments.

In accordance with an aspect of the disclosure, a display system includes: a plurality of display apparatuses connected in series to each other, each display apparatus including: a display, a signal inputter/outputter configured to receive an image signal as a data packet from a preceding display apparatus, and transmit the image signal to a next display apparatus, and a processor configured to: process, for display on the display, an image based on the received image signal, and based on an abnormality in the image displayed on the display, control the signal inputter/outputter to transmit, to the preceding display apparatus, a request for a corrected image signal, of which a signal characteristic in the received image signal is modified.

The corrected image signal, the signal characteristic of which is modified, may correspond to the image signal amplified with an amplification value corresponding to the abnormality in the image displayed on the display.

The processor may be configured to count a number of times that the abnormality in the image displayed on the display is detected, and to control the signal inputter/outputter to transmit, to the preceding display apparatus, a signal correction value corresponding to the counted number of times.

The processor may be configured to count the number of times that image flickering occurs and to obtain the signal correction value based on the abnormality being determined as the image flickering.

The signal inputter/outputter may be configured to receive the image signal from the preceding display apparatus via a communication connection in which a communication connection process with the preceding display apparatus is authenticated; and the processor may be configured to obtain the signal correction value by counting a number of times the communication connection process fails or a number of times the communication connection process is tried again based on the abnormality being determined as a failure in the communication connection process.

The processor may be configured to periodically perform the communication connection process with the preceding display apparatus even after the communication connection process is authenticated.

The processor may be configured to, based on the counter number of times being greater than a preset threshold, control the display to display a message informing the abnormality in the image.

The processor may be configured to perform synchronization of image signal processing based on a clock signal extracted from the image signal received as the data packet.

In accordance with another aspect of the disclosure, a display apparatus includes: a display; a signal inputter/outputter configured to receive an image signal as a data packet from a preceding display apparatus, and transmit the image signal to a next display apparatus among a plurality of display apparatuses of a display system; and a processor configured to: process, for display on the display, an image based on the received image signal, and based on an abnormality in the image displayed on the display, control the signal inputter/outputter to transmit, to the preceding display apparatus, a request for a corrected image signal, of which a signal characteristic in the received image signal is modified.

The corrected image signal, the signal characteristic of which is modified, may correspond to the image signal amplified with an amplification value corresponding to the abnormality in the image displayed on the display.

The processor may be configured to count a number of times that the abnormality in the image displayed on the display is detected, and to control the signal inputter/outputter to transmit, to the preceding display apparatus, a signal correction value corresponding to the counted number of times.

The processor may be configured to count the number of times that image flickering occurs and to obtain the signal correction value based on the abnormality being determined as the image flickering.

The signal inputter/outputter may be configured to receive the image signal from the preceding display apparatus via a communication connection in which a communication connection process with the preceding display apparatus is authenticated; and the processor may be configured to obtain the signal correction value by counting a number of times the communication connection process fails or a number of times the communication connection process is tried again based on the abnormality being determined as a failure in the communication connection process.

The processor may be configured to periodically perform the communication connection process with the preceding display apparatus even after the communication connection process is authenticated.

The processor may be configured to, based on the counted number of times being greater than a preset threshold, control the display to display a message informing the abnormality in the image.

The processor may be configured to perform synchronization of image signal processing based on a clock signal extracted from the image signal received as the data packet.

In accordance with another aspect of the disclosure, a method of controlling a display apparatus includes: receiving an image signal as a data packet from a preceding display apparatus among a plurality of display apparatuses connected in series to each other; processing, for display, an image based on the received image signal; and based on an abnormality in the displayed image, transmitting, to the preceding display apparatus, a request for a corrected image signal, of which a signal characteristic in the received image signal is modified.

The corrected image signal, the signal characteristic of which is modified, may correspond to the image signal amplified with an amplification value corresponding to the abnormality in the displayed image.

The method may further include: counting a number of times that the abnormality in the displayed image is detected; and controlling to transmit, to the preceding display apparatus, a signal correction value corresponding to the counted number of times.

The method may further include, based on the counted number of times being greater than a present threshold, displaying a message informing the abnormality in the image.

In accordance with another aspect of the disclosure, a non-transitory computer-readable recording medium has recorded thereon instructions executable by at least one processor to perform the method.

In accordance with another aspect of the disclosure, a display apparatus includes: a display; a signal inputter/outputter configured to receive an image signal as a data packet from a preceding display apparatus, and transmit the image signal to a next display apparatus among a plurality of display apparatuses of a display system; and a processor configured to: process, for display on the display, an image based on the received image signal, based on receiving a request, from the next display apparatus via the signal inputter/outputter, for a corrected image signal to correct an abnormality in a displayed image displayed by the next display apparatus, modify a signal characteristic in the image signal to obtain the corrected image signal, and control the signal inputter/outputter to transmit, to the next display apparatus, the corrected image signal.

The processor may be configured to modify the signal characteristic by amplifying an amplification value corresponding to the abnormality in the displayed image displayed in the next display apparatus.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 8 illustrates an example of a table to be referenced by a display apparatus according to an embodiment;

FIG. 9 illustrates another example of a table to be referenced by a display apparatus according to an embodiment.

DETAILED DESCRIPTION

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these plural embodiments may be discretionally selected and applied to realize the present inventive concept by a person having ordinary skill in the art.

In the description of embodiments, an ordinal number used in terms such as a first element, a second element, etc., is employed for describing variety of elements, and the terms are used for distinguishing between one element and another element. Therefore, the meanings of the elements are not limited by the terms, and the terms are also used just for explaining the corresponding embodiment without limiting the disclosure.

Further, expressions such as "at least one" among a plurality of elements (e.g., "at least one of [A], [B], and [C]") in the disclosure represents not only all the elements but also each one of the elements, which excludes the other elements or all combinations of the elements (e.g., only A, only B, only C, A and B, A and C, B and C, or A, B, and C).

Figure 1:
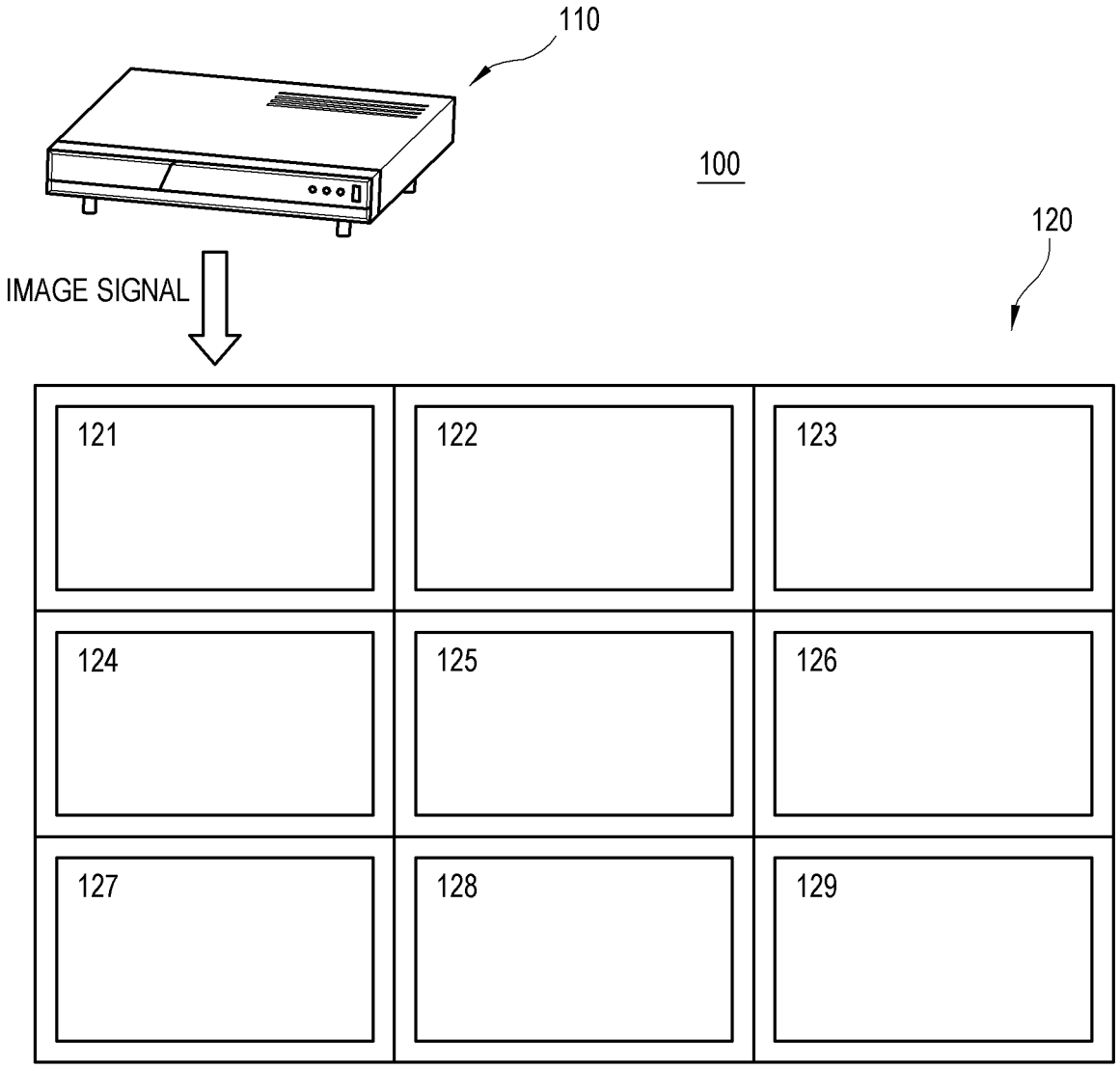
FIG. 1 illustrates an example of a video wall system according to an embodiment.

FIG. 1 illustrates an example of a video wall system 100 according to an embodiment.

As shown in FIG. 1, a video wall system 100 according to an embodiment includes an image source 110, and a plurality of display apparatuses 120 processing an image signal received from the image source 110 and displaying an image. The plurality of display apparatuses 120 are arranged in a matrix form to form a video wall system 100 having a large screen. For example, a digital signage installed outdoors or the like open place must allow people to easily recognize content displayed on a screen thereof. To this end, the digital signage needs to have a large screen. However, there is a manufacturing limit to a typical screen size of a single display apparatus, and therefore many display apparatuses 121, 122, 123, 124, 125, 126, 127, 128 and 129 are combined to form a video wall, thereby achieving a large-screen digital signage.

Each display apparatus of the system 100 receives an image signal from at least one image source 110, and individually processes and displays the received image. For example, each display apparatus selects and displays only an area, which corresponds to its own identification (ID) in the system 100 or a position disposed in the system 100, within a whole area of an image frame based on an image signal. In other words, the plurality of display apparatuses 120 share the area of the image frame with one another and display the shared area, thereby displaying the whole area of the image frame throughout the system 100.

Herein, it is described by way of example that the system 100 is actualized by the video wall, but the plurality of display apparatuses 120 need not be arranged in the matrix form in one or more other embodiments. Alternatively, the plurality of display apparatuses 120 may be arranged in forms other than the matrix.

There are many ways of providing an image signal from the image source 110 to the plurality of display apparatuses 120. In the present embodiment, the loop-out method is used. For example, when an image signal is transmitted from the image source 110 to the first display apparatus 121 among the plurality of display apparatuses 120, the image signal is branched in the first display apparatus 121, one of the branched image signals is transmitted to the processor of the first display apparatus 121, and the other one is transmitted to the second display apparatus 122. A transmission structure for the image signal between the apparatuses 120 may be achieved by at least one of a wired communication and a wireless communication. For convenience, a loop-out method is described in which the plurality of display apparatuses 120 are connected in series as described above and an image signal is transmitted from the image source 110 to the display apparatuses 120 in sequence.

Here, for convenience of description, the plurality of display apparatuses 120 connected for communication based on the loop-out method may be ordered with respect to the image source 110. For example, the first display apparatus 121 is directly connected to the image source 110, and the second display apparatus 122 is directly connected to the first display apparatus 121. Here, the direct connection, for example, means that two apparatuses are connected by the cable and thus signal exchange is possible.

With respect to the image source 110, the first display apparatus 121 precedes the second display apparatus 122 in the loop-out connection order. Likewise, when the plurality of display apparatuses 120 includes nine display apparatuses, the last apparatus in the loop-out connection order may be referred to as the ninth display apparatus 129. Further, the loop-out connection order refers to an order of transmitting the image signal output from the image source 110. It is understood that a method of identifying the plurality of display apparatuses 120 may include various methods, for example, a method of assigning individual identifiers (IDs) to each display apparatus 120.

In terms of the loop-out connection, when an image is abnormally displayed on one among the plurality of display apparatuses 120, it is estimated or determined that there is something wrong between the corresponding display apparatus and the preceding display apparatus preceding the corresponding display apparatus. For example, when an image is abnormally displayed by the fifth display apparatus 125 and the subsequent display apparatuses 126, 127, 128 and 129, but the image is normally displayed on the preceding display apparatuses 121, 122, 123 and 124, it is estimated or determined that an error in signal transmission occurs between the fourth display apparatus 124 and the fifth display apparatus 125. In this regard, the display apparatus of an embodiment detects and processes an abnormally displayed image, detailed descriptions of which are described below.

Below, a signal transmission structure between a plurality of display apparatuses 120 connected by a loop-out method will be described in detail.

Figure 2:
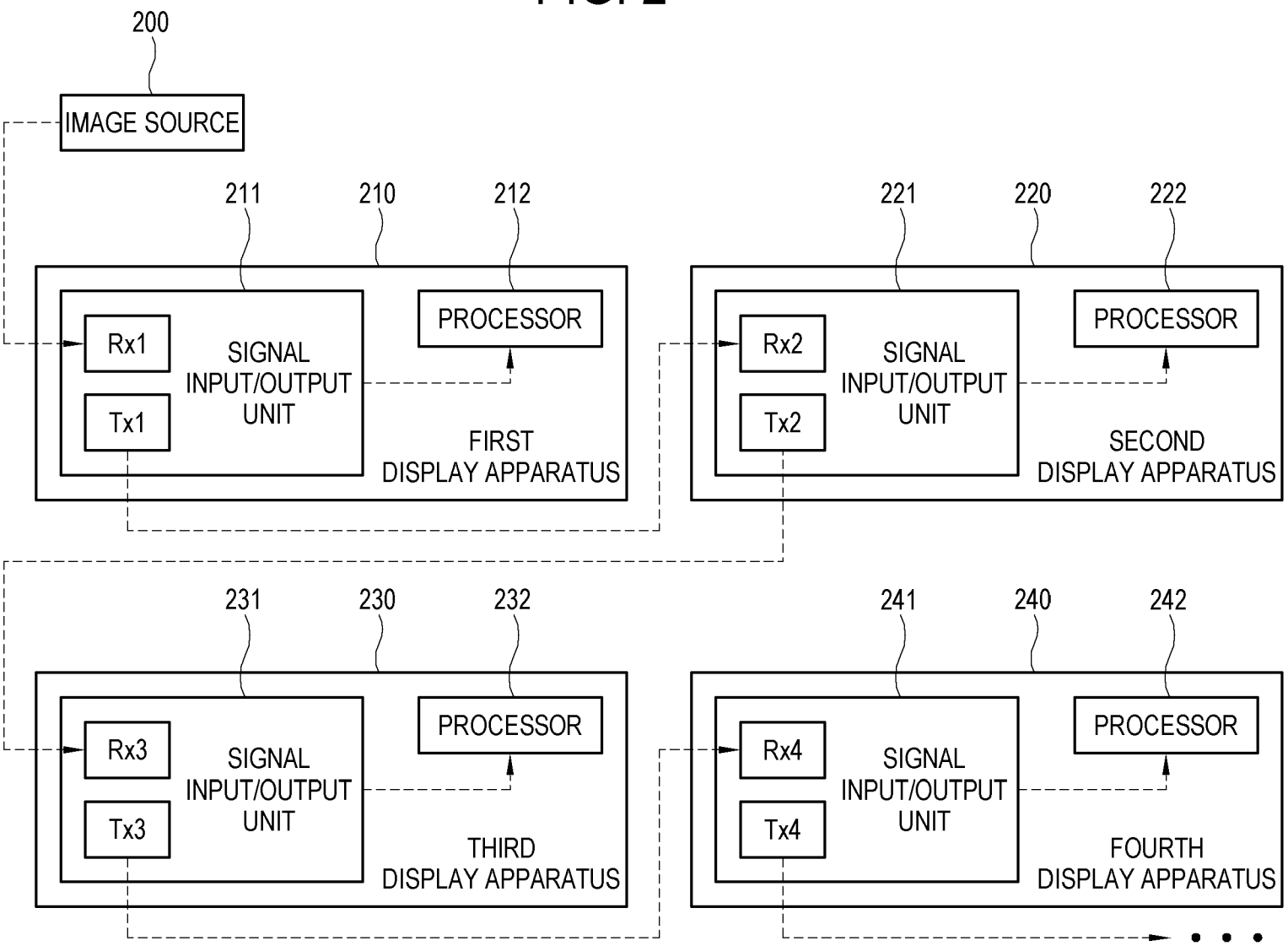
FIG. 2 is a block diagram of a signal transmission relationship among a plurality of display apparatuses in a system according to an embodiment.

FIG. 2 is a block diagram of a signal transmission relationship among a plurality of display apparatuses 210, 220, 230, and 240 in a system according to an embodiment;

As shown in FIG. 2, a plurality of display apparatuses 210, 220, 230, and 240 are connected by the loop-out method. FIG. 2 illustrates a loop-out connection from an image source 200 to the first four display apparatuses 210, 220, 230 and 240 in a loop-out order, but it is understood that more display apparatuses may be consecutively connected to a an end (e.g., back end) of the fourth display apparatus 240 by a method described in this embodiment.

The plurality of display apparatuses 210, 220, 230, and 240 includes a first display apparatus 210, a second display apparatus 220, a third display apparatus 230, and a fourth display apparatus 240 that are connected in sequence. In the following description, it will be described that the apparatuses 210, 220, 230, and 240 are connected by a cable complying with DisplayPort (DP) standards.

The plurality of display apparatuses 210, 220, 230, and 240 respectively include signal input/output units 211, 221, 231 and 241 through which a signal is input and output, and processors 212, 222, 232 and 242 by which the signal is processed. Further, the signal input/output units 211, 221, 231 and 241 respectively include receiving ports Rx1, Rx2, Rx3 and Rx4 to which the signal is input, and transmitting ports Tx1, Tx2, Tx3 and Tx4 from which the signal is output. The display apparatuses 210, 220, 230 and 240 may be identical or different in a model or detailed hardware specifications, but basically includes the hardware components as described above.

A method of transmitting an image signal is as follows. The image source 200 outputs an image signal to Rx1 of the signal input/output unit 211 of the first display apparatus 210. The signal input/output unit 211 of the first display apparatus 210 not only transmits the image signal to the processor 212 of the first display apparatus 210, but also outputs the image signal to the second display apparatus 220 through Tx1. The second display apparatus 220 transmits and processes the image signal received in Rx2 in the same manner as the first display apparatus 210. In this manner, the image signal from the image source 200 is transmitted to all the display apparatuses 210, 220, 230 and 240.

In this embodiment, the terms "receiving" ports Rx1, Rx2, Rx3, and Rx4 and "transmitting" ports Tx1, Tx2, Tx3 and Tx4 are used for convenience according to roles when the image signal is delivered from the image source 200, although it is understood that the terms "receiving" and "transmitting" do not limit the functions of the corresponding ports. For example, predetermined data or a signal may be delivered from the receiving port Rx1, Rx2, Rx3 or Rx4 in an embodiment to the transmitting port Tx1, Tx2, Tx3 or Tx4 through a cable.

Meanwhile, when the signal input/output units 211, 221, 231 and 241 are connected by the DP standards, the signal input/output units 211, 221, 231 and 241 are connected through a main link, an auxiliary (AUX) channel, and a hot plug detect (HPD) signal. The main link refers to a unidirectional channel of high bandwidth and low latency, used in transmitting an image signal. The AUX channel refers to a half-duplex interactive channel used for link management and device control. The HPD signal of an HPD line functions as an interrupt request from a sink device between a source device and the sink device that are connected to each other. A signal transmission line based on the DP standards is described below in more detail.

Below, one of the display apparatuses 210, 220, 230 and 240 will be representatively described with respect to hardware components.

Figure 3:
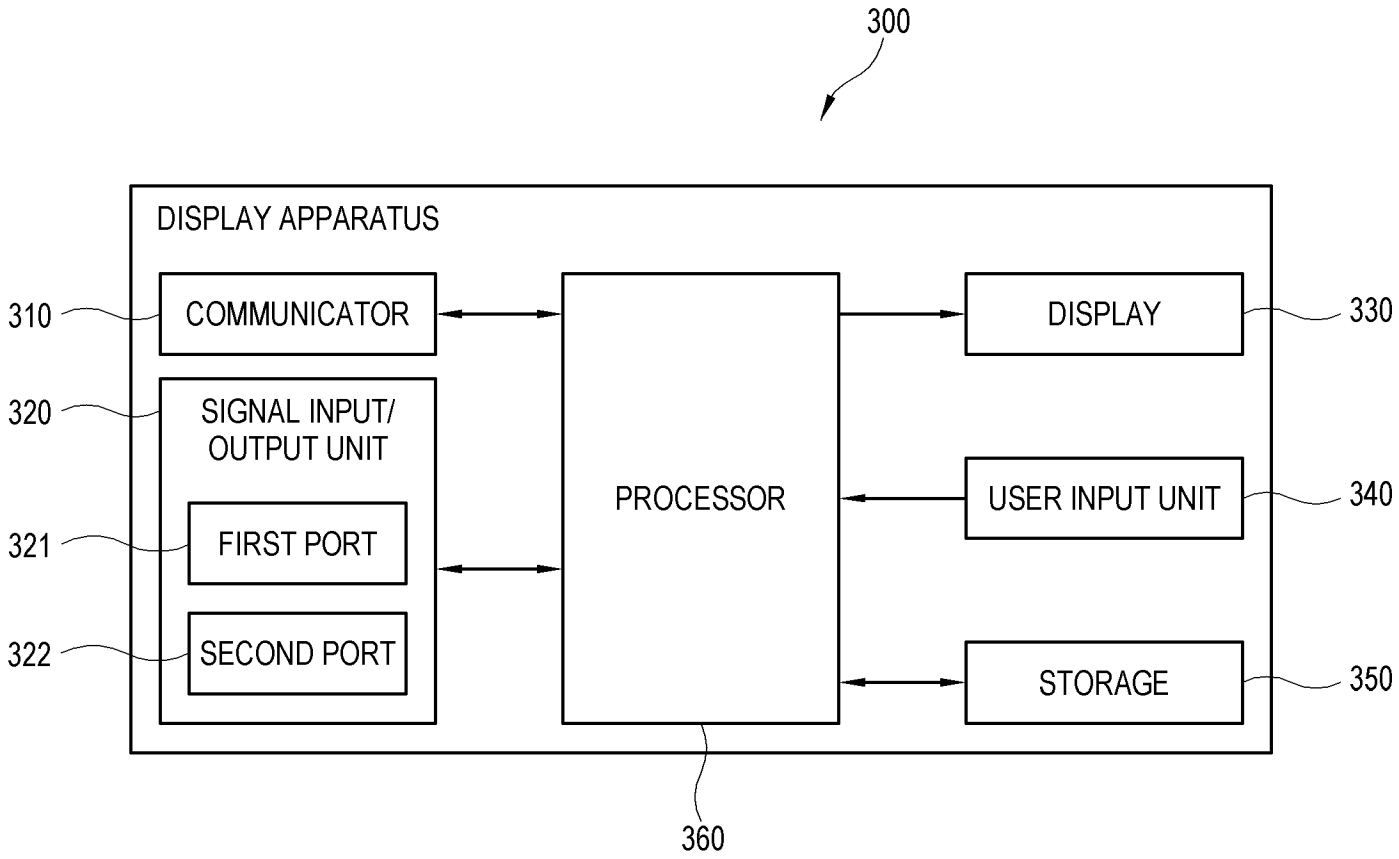
FIG. 3 is a block diagram of a display apparatus in a system according to an embodiment.

FIG. 3 is a block diagram of a display apparatus 300 in a system according to an embodiment.

As shown in FIG. 3, a display apparatus 300 includes a communicator 310 configured to communicate with an external apparatus, a signal input/output unit 320 (e.g., signal input/output circuit or signal inputter/outputter) configured to input/output predetermined data such as an image signal, a display 330 configured to display an image, a user input unit 340 (e.g., user inputter) configured to receive a user input, a storage 350 configured to store data, and a processor 360 (e.g., at least one processor) configured to process the data.

The communicator 310 refers to an interactive communication circuit that includes at least one of elements, such as communication modules, communication chips, etc., corresponding to various wired and wireless communication protocols. For example, the communicator 310 may be realized or implemented by a wireless communication module (e.g., interface and/or circuitry) configured to perform wireless communication with an access point (AP) through Wi-Fi, or a local area network (LAN) connected to a router or a gateway by a wire.

The signal input/output unit 320 is one-to-one or one-to-many connected to a predetermined external device, thereby receiving or outputting data with regard to the corresponding external device. In the present embodiment, the signal input/output unit 320 includes a plurality of connectors or a plurality of ports, which comply with the DP standards. According to an embodiment, the signal input/output unit 320 may be connected to another display apparatus or an image source. The signal input/output unit 320 may, for example, include a first port 321 connected to the preceding display apparatus and a second port 322 connected to the following display apparatus.

The display 330 includes a display panel capable of displaying an image on a screen. The display panel is provided to have a light receiving structure such as a liquid crystal type, or a self-emissive structure such as an organic light emitting diode (OLED) type. The display 330 may include an additional element according to the structures of the display panel. For example, when the display panel is the liquid crystal type, the display 330 includes a liquid crystal display panel, a backlight unit configured to emit light, a panel driving substrate configured to drive liquid crystal of the liquid crystal display panel, etc.

The user input unit 340 includes various input interfaces through which a user can make an input. The user input unit 340 may be variously configured according to the type of display apparatus 300, and may for example include mechanical or electronic buttons of the display apparatus 300, a remote controller separated from the display apparatus 300, a touch pad, a touch screen provided on the display 330, etc.

The storage 350 is accessed by the processor 360, and performs operations such as reading, recording, modifying, deleting, updating, etc., for data under control of the processor 360. The storage 350 includes a flash memory, a hard disk drive (HDD), a solid state drive (SSD), and the like nonvolatile memory in which data is retained regardless of whether power is supplied or not; and a buffer, a random access memory (RAM) and the like volatile memory to which processing data is loaded.

The processor 360 includes one or more hardware processors achieved by a central processing unit (CPU), a chipset, a microcontroller, circuit, etc., that are mounted on a printed circuit board (PCB). Alternatively, the processor 360 may be designed as a system on chip (SoC). The processor 218 include modules corresponding to various processes, such as a demultiplexer, a decoder, a scaler, an audio digital signal processor (DSP), an amplifier, etc., and some or all of the modules may be achieved by the SoC. For example, a demultiplexer, a decoder, a scaler, and the like module related to an image process may be realized as an image processing SoC, and an audio DSP may be realized as a chipset separated from the SoC.

The processor 360 serves as a main hardware agent that carries out general operations of the display apparatus 300. In other words, the processor 360 executes a preset instruction stored in the storage 350 so as to perform operations of the display apparatus 300. In view of software, the predetermined operation of the display apparatus 300 is performed by the operating system or kernel or by an application executed on the kernel, and the processor 360 performs calculation, process and control for data to execute the software. For example, the processor 360 executes the operating system or the kernel of the display apparatus 300, and also executes an application or a program on the kernel, thereby carrying out the processes.

By this configuration, the display apparatus 300 according to an embodiment operates as follows.

Figure 4:
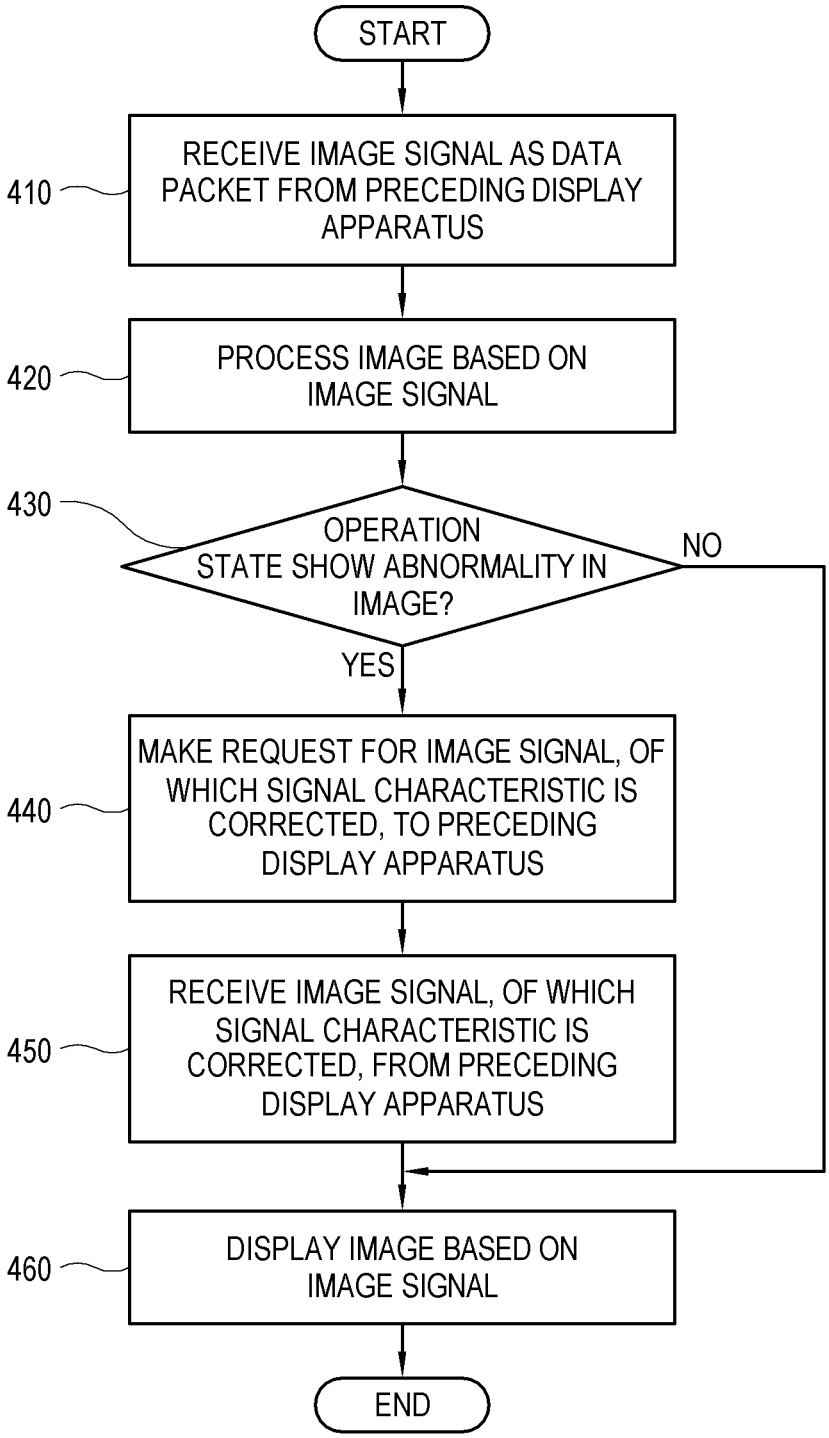
FIG. 4 is a flowchart showing a method of controlling a display apparatus according to an embodiment.

FIG. 4 is a flowchart showing a method of controlling a display apparatus according to an embodiment.

As shown in FIG. 4, the following operations are carried out by the processor of the display apparatus.

At operation 410, the display apparatus receives an image signal in the form of a data packet from the preceding display apparatus (or the image source).

At operation 420, the display apparatus processes an image to be displayed based on the image signal received in the form of the data packet.

At operation 430, the display apparatus identifies whether an operation state shows abnormality in an image. A configuration by which the display apparatus identifies the abnormality in the image is described below.

When it is identified that the operation state of the display apparatus shows the abnormality in the image, the display apparatus requests the preceding display apparatus to transmit an image signal of which a signal characteristic is corrected at operation 440.

At operation 450, the display apparatus receives the image signal (e.g., corrected image signal), of which the signal characteristic is corrected by the request, from the preceding display apparatus. A configuration by which the signal characteristic of the image signal is corrected is described below.

At operation 460, the display apparatus displays an image based on the image signal.

On the other hand, when it is identified in the operation 430 that the operation state of the display apparatus does not show the abnormality in the image, the display apparatus enters the operation 460 and displays an image based on the image signal.

Thus, the display apparatus according to an embodiment can automatically identify a problem that an image is abnormally displayed under the condition of connecting with other display apparatuses by the loop-out method, and take a measure so as to normally display the image.

When the display apparatus receives the image signal from the preceding display apparatus, the preceding display apparatus that transmits the image signal may be referred to as a source apparatus, and the display apparatus that receives the image signal may be referred to as a sink apparatus. There are many ways of transmitting the image signal. The foregoing operations according to an embodiment are performed when the sink apparatus receives the image signal in the form of the data packet from the source apparatus. As an example of transmitting the image signal in the form of the data packet, there may be the DP standards. However, it is understood that the DP standards are exemplarily described, and one or more other embodiments are not limited the DP standards but also all standards for transmitting the image signal in the form of the data packet.

Below, operations of the foregoing embodiment, for example, when the image signal is transmitted by the DP standards, are described in more detail. For comparison with the present embodiment, it will also be described that the image signal is transmitted in forms other than the data packet, for example, that raw data together with a clock signal is transmitted from the source apparatus to the sink apparatus like in high definition multimedia interface (HDMI) standards.

Figure 5:
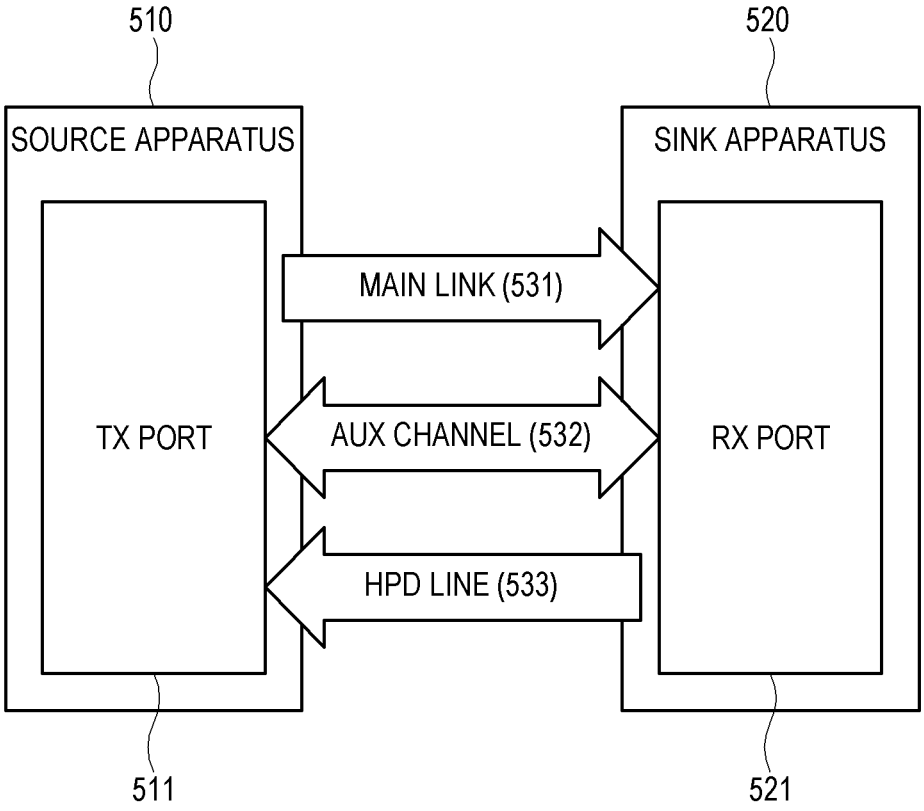
FIG. 5 is a block diagram of a signal transmission channel based on DisplayPort (DP) standards of a display apparatus according to an embodiment.

FIG. 5 is a block diagram of a signal transmission channel based on the DP standards of a display apparatus according to an embodiment.

As shown in FIG. 5, for convenience of description, the preceding display apparatus will be referred to as a source apparatus 510, and a display apparatus that receives an image signal from the source apparatus 510 will be referred to as a sink apparatus 520. The signal input/output unit of the source apparatus 510 includes one or more Tx ports 511, and the signal input/output unit of the sink apparatus 520 includes one or more Rx ports 521. The Tx port 511 and the Rx port 521 support the DP standards, and are connected by a cable based on the DP standards.

Each of the Tx port 511 and Rx port 521 includes a plurality of terminals divided into a main link 531, an AUX channel 532, and an HPD line 533 according to the DP standards.

The main link 531 includes a plurality of lanes through which isochronous streams are respectively transmitted. The main link 531 does not include any separate channel or lane for transmitting a clock signal, and the clock signal needed for the sink apparatus 520 to synchronize the operations of processing an image signal is extracted from the stream transmitted through the main link 531. An image stream transmitted through the main link 531, i.e., an image signal, is transmitted in units not of raw data, but of a data packet. In other words, the sink apparatus 520 receives the image signal from the source apparatus 510 in units of the packet, and processes the image signal in units of the packet. In the source apparatus 510, the image signal is packaged into a micro-packet that is called a transfer unit. The length of micro-packet may, for example, range from 32 to 64 link symbols per lane.

When the source apparatus 510 is connected to the Rx port 521 through the cable based on the DP standards, the sink apparatus 520 sends an HPD signal to the source apparatus 510 through the HPD line 533, thereby informing that the source apparatus 510 and the sink apparatus 520 are connected to each other. The source apparatus 510 sends check data for communication with the sink apparatus 520 through the AUX channel 532, and performs an operation for receiving the acknowledgement data corresponding to this check data from the sink apparatus 520. This operation refers to a communication connection process for communication between the source apparatus 510 and the sink apparatus 520, and is may be referred to as link training.

When the link training succeeds or is authenticated, the source apparatus 510 identifies a concrete method of how to transmit an image signal through the main link 531, for example, identifies the number of lanes of the main link 531 to be used in transmitting the signal, mapping of signals to be transmitted to the lanes, a link rate, etc. After such a concrete method is identified, the source apparatus 510 transmits the image signal through the main link 531, and the sink apparatus 520 receives the image signal through the Rx port 521. In other words, according to the DP standards, the source apparatus 510 and the sink apparatus 520 are not required to just be electrically connected to each other by the cable in order to transmit and receive a signal. According to the DP standards, a concrete method of transmitting a signal is identified through the link training, and then the signal is transmitted and received by the identified method.

The link training may be performed at a point in time when the source apparatus 510 and the sink apparatus 520 are first connected to each other. Alternatively, the link training may be periodically performed even while the communication between the source apparatus 510 and the sink apparatus 520 is enabled. In other words, the sink apparatus 520 may periodically perform the link training with the source apparatus 510 while connecting with the source apparatus 510 and receiving the image signal from the source apparatus 510, thereby identifying whether there is abnormality in transmitting the signal.

For comparison with the embodiment in which the image signal is transmitted in the form of the data packet, a related art where the raw data of the image signal is directly transmitted will be taken into account. In a case of the related art, for example, the HDMI standards, there are provided a plurality of transition-minimized differential signaling (TMDS) channels for TMDS between the source apparatus and the sink apparatus, a clock channel for transmitting a clock signal, a display data channel (DDC) for information communication, etc. The TMDS is not an interrupted data packet but a continuous data stream, and transmitted together with the clock signal to synchronously make or cause the sink apparatus process the TMDS.

In such an HDMI case, there are no needs for unpackaging the packet of the data stream, and the sink apparatus easily detects an error bit by monitoring the data bit of the clock signal and the TMDS in real time because the clock signal is transmitted from the source apparatus to the sink apparatus.

On the other hand, according to the DP standards as implemented in an embodiment in which an image signal is transmitted as the data packet without the clock signal, it may be difficult (e.g., functionally difficult or resource-intensive) for the sink apparatus to monitor the image signal in real time and detect an error bit unlike the HDMI standards.

Thus, according to an embodiment, when the sink apparatus detects that the operation state of the sink apparatus shows abnormality in displaying an image based on an image signal received from the source apparatus, the sink apparatus requests the source apparatus to transmit an image signal of which a preset signal characteristic is corrected. Thus, the sink apparatus may receive the image signal, of which the preset signal characteristic is corrected in response to the request, from the source apparatus so that the image can be normally displayed.

A detailed description of a display apparatus operating when abnormality in an image is detected is provided below.

Figure 6:
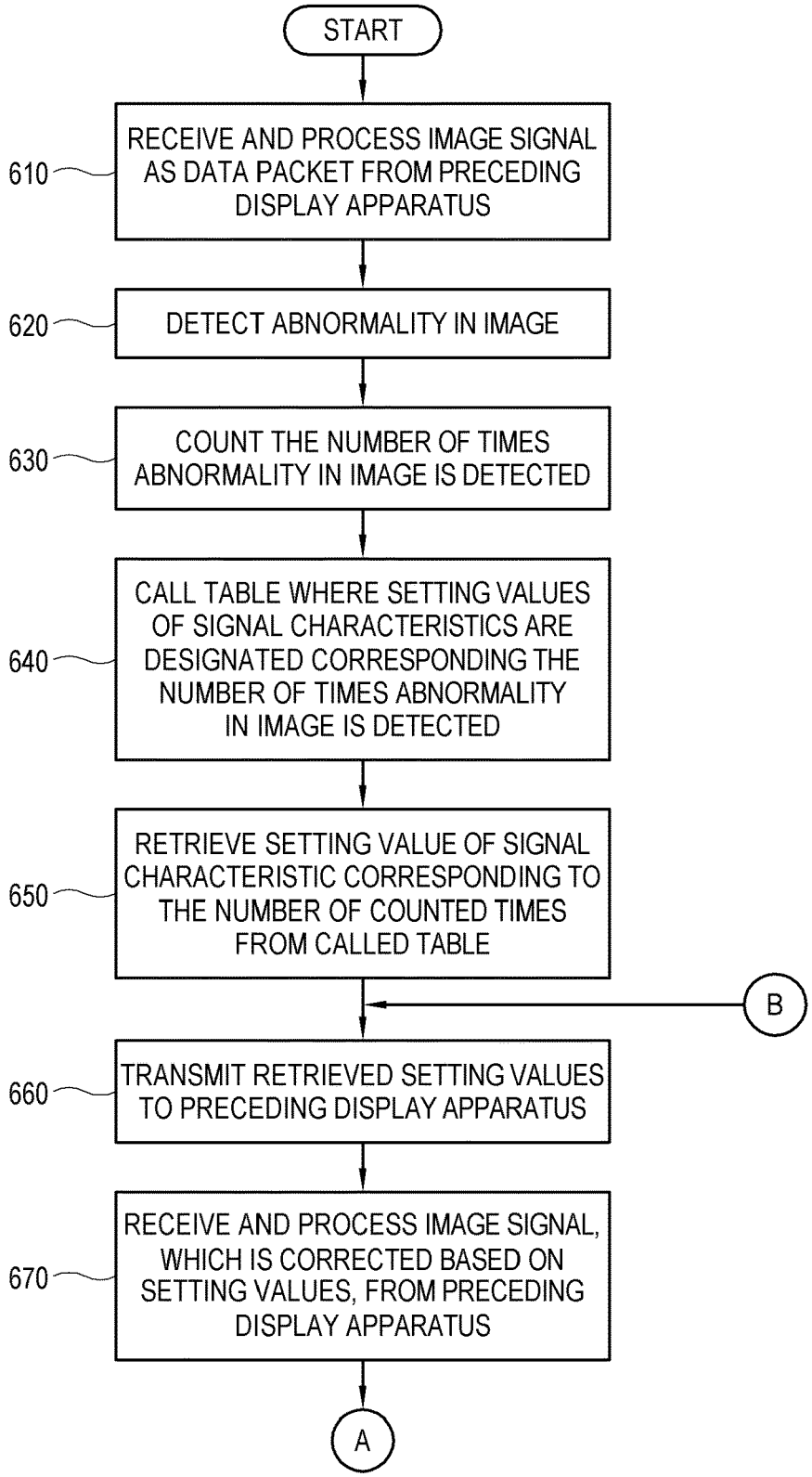
FIGS. 6 and 7 are flowcharts showing operation when a display apparatus according to an embodiment detects an abnormality in an image.
Figure 7:
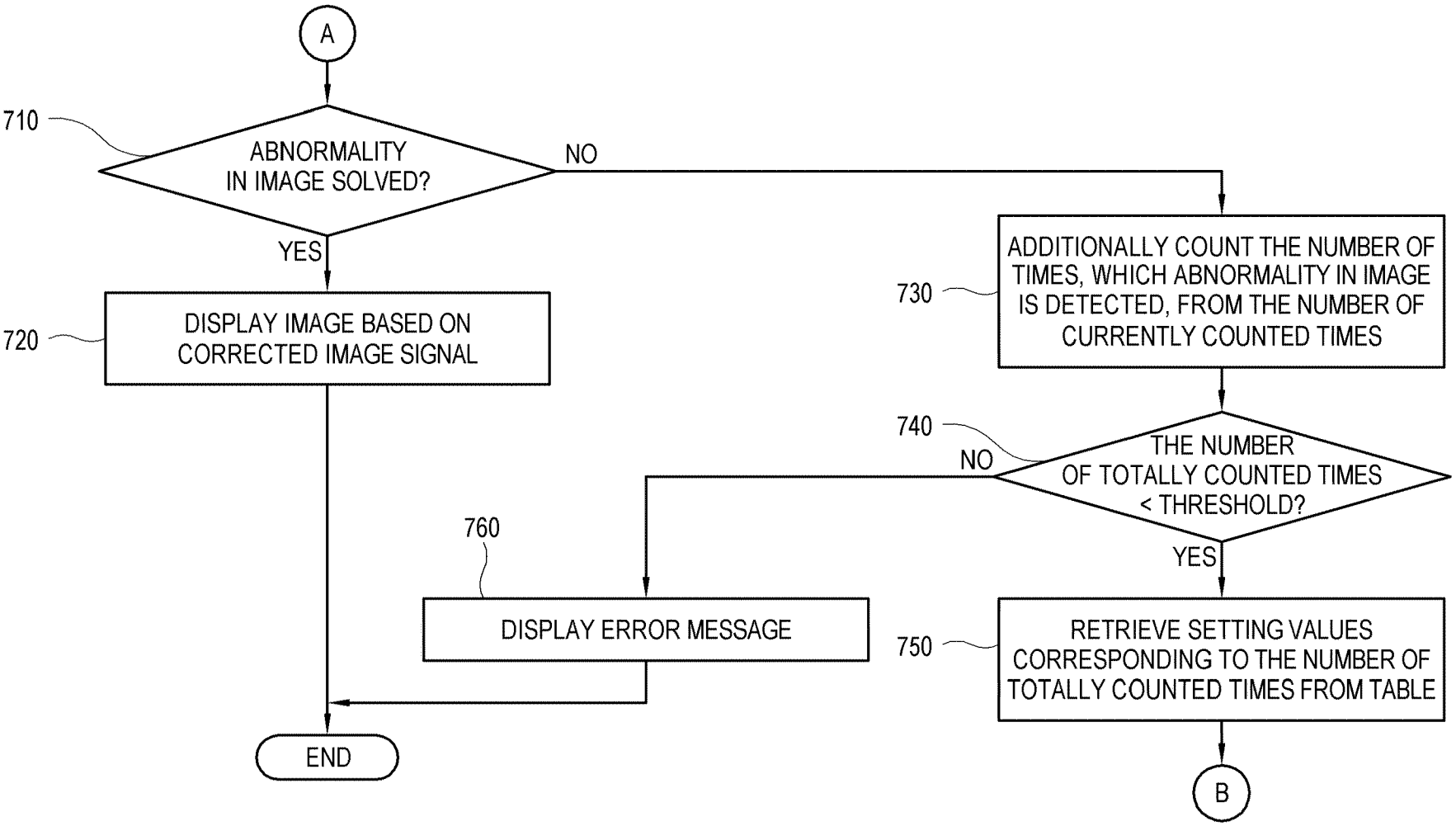

FIGS. 6 and 7 are flowcharts showing operations when (e.g., based on) a display apparatus according to an embodiment detects abnormality in an image.

As shown in FIGS. 6 and 7, the following operations are carried out by the processor of the display apparatus.

At operation 610, the display apparatus receives an image signal in the form of a data packet from the preceding display apparatus, and processes the image signal to be displayed as an image.

At operation 620, the display apparatus detects abnormality in an image.

At operation 630, the display apparatus counts the number of times abnormality in an image is detected.

At operation 640, the display apparatus calls (or loads, obtains, searches, etc.) a table in which a setting value for a signal characteristic is designated corresponding to the number of times that abnormality in an image is detected.

At operation 650, the display apparatus retrieves the setting value for the signal characteristic, which corresponds to the counted number of times, from the called table.

At operation 660, the display apparatus transmits the retrieved setting value to the preceding display apparatus, and makes a request for an image signal that is corrected based on the setting value.

At operation 670, the display apparatus receives and processes an image signal, which is corrected based on a matching setting value, from the preceding display apparatus.

At operation 710, the display apparatus identifies whether or not the abnormality in the image is resolved.

When it is identified that the abnormality in the image is resolved by the corrected image signal, the display apparatus displays an image based on the corrected image signal at operation 720.

On the other hand, when it is identified that the abnormality in the image is not resolved by even the corrected image signal, the display apparatus counts the number of times in addition to the currently counted number of times with respect to the abnormality in the image at operation 730.

At operation 740, the display apparatus identifies whether the total counted number of times is lower than a preset threshold.

When the total number of counted times is lower than the threshold, the display apparatus retrieves the setting value corresponding to the total number of counted times from the table at operation 750, and returns to the operation 660.

On the other hand, when the total number of counted times is not lower than the threshold, the display apparatus displays an error message at operation 760.

The operations 730 to 760 are performed when the abnormality in the image is not solved by the image signal corrected corresponding to the counted number of times (i.e., primarily counted number of times). Thus, the display apparatus secondarily counts the number of times, in which abnormality in an image is detected, not from "0" but in addition to the primarily counted number of times, and obtains a setting value of a signal characteristic corresponding to the total counted number of times. Further, the display apparatus receives and processes an image signal corrected according to the newly obtained setting value. Nevertheless, when the abnormality in the image is not resolved, the display apparatus repeats the foregoing operations.

When the number of repeated foregoing operations reaches a preset limit, the abnormality in the image may be a problem that is not autonomously solvable by the display apparatus. Thus, the display apparatus displays an error message in operation 760 to thereby inform a user that there is a need for taking a measure.

Further, in the present embodiment, it has been described that the display apparatus counts the number of times that the abnormality in the image is detected, and if the abnormality in the image is not resolved, accumulates the counted number of times. However, the display apparatus may not accumulatively count the number of times but restart counting from "0" when a preset event occurs. For example, such an event occurs when the HPD signal is reset through the HPD line because the cable between the display apparatus and the preceding display apparatus is disconnected from and then reconnected to the port, because the cable is replaced, or for the like reasons.

In the present embodiment, there are many ways for the display apparatus to identify whether an image is abnormal or not, and about how the signal characteristics of the image signal is corrected. For example, the display apparatus may identify abnormality in an image when no image is displayed by a failure in the link training, or when an image is flickering. Further, the display apparatus may cause or control an image signal to be corrected in the signal characteristics of the image signal by a method of amplifying the image signal to increase the strength of the image signal. One or more embodiments of the foregoing methods are described below.

FIG. 8 illustrates an example of a table 800 to be referenced by a display apparatus according to an embodiment.

As shown in FIG. 8, a table 800 is configured to designate a VOD value and a PRE value corresponding to the number of times that the link training is failed. VOD and PRE refer to setting values related to amplification of a signal when the signal is sent from Tx to Rx based on the DP standards. The VOD means voltage swing, indicates an amplitude of an electric signal, and is given in units of microampere (μA). The PRE means pre-emphasis, indicates a value for applying overshooting potential to a transmission signal, and is given in units of decibel (dB).

In the table 800, the setting values are tabulated to increasingly amplify the signal as the number of times that the link training fails increases. This is because the plurality of display apparatuses are connected by the loop-out method and thus more noise is accumulated in the image signal as the cables or connection nodes increase backward even though the plurality of display apparatuses are normally connected to each other through the cables. When the accumulated noise exceeds a predetermined threshold, it is difficult to normally process an image signal in the received signal. Therefore, the table 800 is set to increase the strength of the image signal against noise with the increased number of times the link training fails.

The display apparatus performs the link training with respect to the preceding display apparatus. In this case, when the link training fails and a signal loss occurs, an image is abnormally displayed. When the link training fails, the display apparatus counts the number of times that the link training fails, or counts the number of retrying times that the link training is tried again after the link training fails.

The display apparatus retrieves an amplification value for the signal, which corresponds to the counted number of times, from the table 800. According to the table 800, a VOD value is "100" and a PRE value is "0" in a default state of when the link training succeeds, i.e., when the number of times the link training fails is zero. Basically, the preceding display apparatus transmits an image signal based on the VOD value and the PRE value of the default state.

When a failure in the link training is detected and the number of times the link training fails is counted as "1," the display apparatus may obtain a VOD value of "120" and a PRE value of "0" corresponding to one failure in the link training from the table 800. The display apparatus transmits the VOD value of "120" and the PRE value of "0" obtained from the table 800 to the preceding display apparatus.

The preceding display apparatus corrects the image signal to be amplified based on signal amplification values such as the VOD value of "120" and the PRE value of "0" received from the display apparatus, and transmits the corrected image signal to the display apparatus. The display apparatus checks the received image signal, and displays an image when abnormality in the image is not detected as a check result but operates as follows when abnormality in the image is still detected.

The display apparatus counts again the number of times the link training fails in addition to the number of times counted for the first time, i.e., in addition to one failure in the like training. The number of times counted again is greater than the number of times counted for the first time. For example, when the failure in the link training is counted twice after one failure counted for the first time, the display apparatus may obtain a VOD value of "140" and a PRE value of "3.5," which correspond to three counted failures, from the table 800. The display apparatus transmits the obtained VOD value of "140" and the obtained PRE value of "3.5" to the preceding display apparatus, and receives a corrected image signal. Nevertheless, when the abnormality in the image is still detected, the display apparatus repeats the foregoing operations until the number of accumulatively counted times the link training is failed does not exceed a preset threshold, e.g., eleven times.

When the number of accumulatively counted times the link training fails exceeds eleven times, it means that only the amplification of the signal is not enough to resolve the abnormality in the image. Thus, the display apparatus displays an error message to inform a user that there is a need for taking a corrective or diagnostic step manually.

Below will be described a different embodiment by which the display apparatus causes a signal characteristic of an image signal be corrected based a table tabulated in a different way from the foregoing embodiment.

FIG. 9 illustrates another example of a table 900 to be referenced by a display apparatus according to an embodiment.

As shown in FIG. 9, a table 900 is configured to designate a VOD value and a PRE value corresponding to the number of times that image flickering occurs. Like the foregoing embodiment, VOD and PRE refer to setting values related to amplification of a signal when the signal is sent from Tx to Rx based on the DP standards.

In the table 900, the setting values are tabulated to increasingly amplify the signal as the number of times that the image flickering occurs increases. The display apparatus makes an image flicker when it is identified that relatively high noise mixes with an image signal and makes it difficult to normally display an image even though the link training normally succeeds. When the image flickers, the display apparatus counts the number of times the image flickering occurs.

The display apparatus retrieves an amplification value for the signal, which corresponds to the number of counted times, from the table 900. According to the table 900, a VOD value is "100" and a PRE value is "0" in a default state in which the image does not flicker, i.e., when the number of times the image flicking occurs is zero. Basically, the preceding display apparatus transmits an image signal based on the VOD value and the PRE value of the default state.

When the image flickering occurs and the number of times the image flickering occurs is counted as "3," the display apparatus may obtain a VOD value of "160" and a PRE value of "0," which correspond to three times the image flickering occurs, from the table 900. The display apparatus transmits the VOD value of "160" and the PRE value of "0" obtained from the table 900 to the preceding display apparatus.

The preceding display apparatus corrects the image signal to be amplified based on signal amplification values such as the VOD value of "120" and the PRE value of "0" received from the display apparatus, and transmits the corrected image signal to the display apparatus. The display apparatus checks the received image signal, and displays an image when abnormality in the image is not detected as a check result but operates as follows when abnormality in the image is still detected.

The display apparatus counts again the number of times the image flickering occurs in addition to the number of times counted for the first time, i.e., in addition to three times the image flickering occurs. The number of times counted again is greater than the number of times counted for the first time. For example, when the image flickering is additionally counted four times after the image flickering is counted three times for the first time, the display apparatus may obtain a VOD value of "160" and a PRE value of "3.5," which correspond to seven times of the image flickering, from the table 900. The display apparatus transmits the obtained VOD value of "160" and the obtained PRE value of "3.5" to the preceding display apparatus, and receives a corrected image signal. Nevertheless, when the abnormality in the image is still detected, the display apparatus repeats the foregoing operations until the number of accumulatively counted times the image flickering occurs does exceeds a preset threshold, e.g., thirty times.

When the number of accumulatively counted times the image flickering occurs exceeds thirty times, it means that only the amplification of the signal is not enough to resolve the abnormality in the image. Thus, the display apparatus displays an error message to inform a user that there is a need for taking a step manually to diagnose or correct the abnormality.

Figure 10:
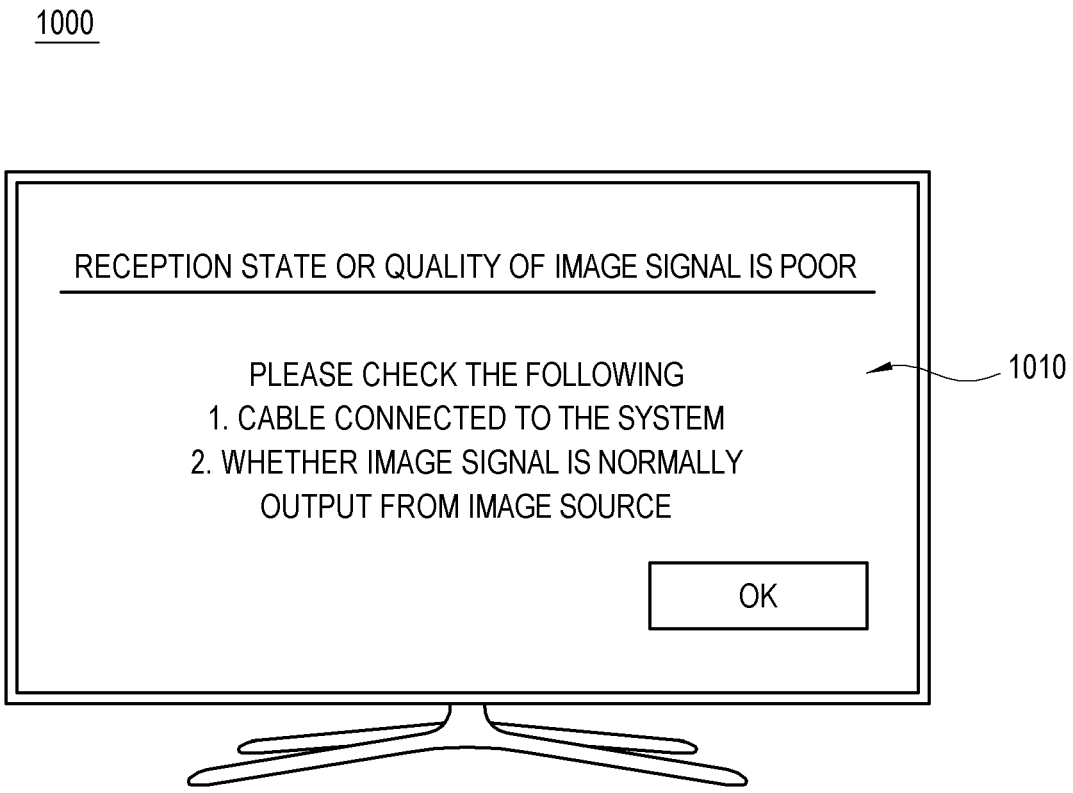
FIG. 10 illustrates an example of an error message displayed by a display apparatus according to an embodiment.

FIG. 10 illustrates an example of an error message displayed by a display apparatus 1000 according to an embodiment.

As shown in FIG. 10, a display apparatus 1000 displays an error message or user interface (UI) 1010 to notify an image abnormal state that an image based on an image signal is not displayable when the number of times counted with respect to the abnormality in the image exceeds a preset threshold.

The UI 1010 includes information to inform that an image from an image source is not normally displayable. In addition, the UI 1010 may simply inform a user of an estimated cause of abnormality and a step the user can take.

Further, while displaying the UI 1010 or instead of displaying the UI 1010, the display apparatus 1000 may transmit image information of the UI 1010 to a server or an external apparatus, with which the display apparatus 1000 can communicate, so that the UI 1010 can be displayed by the server or the external apparatus. For example, the display apparatus 1000 may cause the UI 1010 be displayed on a server or mobile phone of a manager who manages the system, so that the manager can recognize a situation and take an appropriate step.

The operations of the apparatus described in the foregoing embodiments may be performed by artificial intelligence provided in the corresponding apparatus. The artificial intelligence may be applied to various general systems by utilizing a machine learning algorithm. An artificial intelligence system refers to a computer system with intelligence of a human. In such a system, a machine, an apparatus or a system autonomously performs leaning and identifying and is improved in accuracy of recognition and identification based on accumulated experiences. The artificial intelligence is based on elementary technology by utilizing machine learning (deep-running) technology and algorithms based on an algorithm of autonomously classifying and learning features of input data, and copying perception, identification and the like functions of a human brain.

The elementary technology may for example include at least one of language comprehension technology for recognizing a language and a text of a human, visual understanding technology for recognizing a thing like a human sense of vision, inference and prediction technology for identifying information and logically making inference and prediction, knowledge representation technology for processing experience information of a human into knowledge data, and motion control technology for controlling a vehicle's automatic driving or a robot's motion.

Here, linguistic comprehension refers to technology of recognizing, applying and processing a human's language or text, and includes natural language processing, machine translation, conversation system, question and answer, voice recognition and synthesis, etc.

Inference and prediction refer to technology of identifying information and logically making prediction, and includes knowledge- and probability-based inference, optimized prediction, preference-based plan, recommendation, etc.

Knowledge representation refers to technology of automating a human's experience information into knowledge data, and includes knowledge building such as data creation and classification, knowledge management such as data utilization, etc.

The methods according to the foregoing embodiments may be achieved in the form of a program command or instructions that can be implemented in various computers, and recorded in a computer readable medium. Such a computer readable medium may record a program command, a data file, a data structure or the like, or combination thereof. For example, the computer readable medium may be stored in a volatile or nonvolatile storage such as a read only memory (ROM) or the like, regardless of whether it is deletable or rewritable, for example, a RAM, a memory chip, a device or integrated circuit (IC) or the like memory, or an optically or magnetically recordable or machine (e.g., a computer)-readable storage medium, for example, a compact disk (CD), a digital versatile disk (DVD), a magnetic disk, a magnetic tape or the like. It will be appreciated that a memory, which can be included in a mobile terminal, is an example of the machine-readable storage medium suitable for storing a program having instructions for realizing the embodiments. The program command recorded in this storage medium may be specially designed and configured according to the embodiments, or may be publicly known and available to those skilled in the art of computer software.

Although a few embodiments have been shown and described, it will be appreciated by those skilled in the art that changes may be made in these embodiments without departing from the principles and spirit of the inventive concept(s), the scope of which is defined in the appended claims and their equivalents.

What is claimed is:

1. A display system comprising:

a plurality of display apparatuses connected in series to each other, each display apparatus comprising:

a display, a signal inputter/outputter configured to receive an image signal as a data packet from a preceding display apparatus, and transmit the image signal to a next display apparatus, and a processor configured to:

process, for display on the display, an image based on the received image signal, and based on an abnormality in the image displayed on the display, control the signal inputter/outputter to transmit, to the preceding display apparatus, a request for a corrected image signal, of which a signal characteristic in the received image signal is modified, wherein the processor is configured to count a number of times that the abnormality in the image displayed on the display is detected, and to control the signal inputter/outputter to transmit, to the preceding display apparatus, a signal correction value corresponding to the counted number of times.

2. The display system according to claim 1, wherein the corrected image signal, the signal characteristic of which is modified, corresponds to the image signal amplified with an amplification value corresponding to the abnormality in the image displayed on the display.

3. The display system according to claim 1, wherein the processor is configured to count the number of times that image flickering occurs and to obtain the signal correction value based on the abnormality being determined as the image flickering.

4. The display system according to claim 1, wherein:

the signal inputter/outputter is configured to receive the image signal from the preceding display apparatus via a communication connection in which a communication connection process with the preceding display apparatus is authenticated; and the processor is configured to obtain the signal correction value by counting a number of times the communication connection process fails or a number of times the communication connection process is tried again based on the abnormality being determined as a failure in the communication connection process.

5. The display system according to claim 4, wherein the processor is configured to periodically perform the communication connection process with the preceding display apparatus even after the communication connection process is authenticated.

6. The display system according to claim 1, wherein the processor is configured to, based on the counter number of times being greater than a preset threshold, control the display to display a message informing the abnormality in the image.

7. The display system according to claim 1, wherein the processor is configured to perform synchronization of image signal processing based on a clock signal extracted from the image signal received as the data packet.

8. A display apparatus comprising:

a display;

a signal inputter/outputter configured to receive an image signal as a data packet from a preceding display apparatus, and transmit the image signal to a next display apparatus among a plurality of display apparatuses of a display system; and a processor configured to:

process, for display on the display, an image based on the received image signal, and based on an abnormality in the image displayed on the display, control the signal inputter/outputter to transmit, to the preceding display apparatus, a request for a corrected image signal, of which a signal characteristic in the received image signal is modified, wherein the processor is configured to count a number of times that the abnormality in the image displayed on the display is detected, and to control the signal inputter/outputter to transmit, to the preceding display apparatus, a signal correction value corresponding to the counted number of times.

9. The display apparatus according to claim 8, wherein the corrected image signal, the signal characteristic of which is modified, corresponds to the image signal amplified with an amplification value corresponding to the abnormality in the image displayed on the display.

10. The display apparatus according to claim 8, wherein the processor is configured to count the number of times that image flickering occurs and to obtain the signal correction value based on the abnormality being determined as the image flickering.

11. The display apparatus according to claim 8, wherein:

the signal inputter/outputter is configured to receive the image signal from the preceding display apparatus via a communication connection in which a communication connection process with the preceding display apparatus is authenticated; and the processor is configured to obtain the signal correction value by counting a number of times the communication connection process fails or a number of times the communication connection process is tried again based on the abnormality being determined as a failure in the communication connection process.

12. The display apparatus according to claim 11, wherein the processor is configured to periodically perform the communication connection process with the preceding display apparatus even after the communication connection process is authenticated.

13. The display apparatus according to claim 8, wherein the processor is configured to, based on the counted number of times being greater than a preset threshold, control the display to display a message informing the abnormality in the image.

14. The display apparatus according to claim 8, wherein the processor is configured to perform synchronization of image signal processing based on a clock signal extracted from the image signal received as the data packet.

15. A method of controlling a display apparatus, the method comprising:

receiving an image signal as a data packet from a preceding display apparatus among a plurality of display apparatuses connected in series to each other;

processing, for display, an image based on the received image signal; and based on an abnormality in the displayed image, transmitting, to the preceding display apparatus, a request for a corrected image signal, of which a signal characteristic in the received image signal is modified, wherein the transmitting the request comprises counting a number of times that the abnormality in the image displayed on the display is detected, and transmitting, to the preceding display apparatus, a signal correction value corresponding to the counted number of times.

16. The method according to claim 15, wherein the corrected image signal, the signal characteristic of which is modified, corresponds to the image signal amplified with an amplification value corresponding to the abnormality in the displayed image.

17. A display apparatus comprising:

a display;

a signal inputter/outputter configured to receive an image signal as a data packet from a preceding display apparatus, and transmit the image signal to a next display apparatus among a plurality of display apparatuses of a display system; and a processor configured to:

process, for display on the display, an image based on the received image signal, based on receiving a request, from the next display apparatus via the signal inputter/outputter, for a corrected image signal to correct an abnormality in a displayed image displayed by the next display apparatus, modify a signal characteristic in the image signal to obtain the corrected image signal, and control the signal inputter/outputter to transmit, to the next display apparatus, the corrected image signal, wherein the processor is configured to modify the signal characteristic based on a signal correction value, received from the next display apparatus, corresponding to a counted number of times that the abnormality in the image displayed by the next display apparatus is detected.

18. The display apparatus of claim 17, wherein the processor is configured to modify the signal characteristic by amplifying an amplification value corresponding to the abnormality in the displayed image displayed in the next display apparatus.

* * * * *